US005454745A

United States Patent [19]

Spielberger

[11] Patent Number: 5,454,745

[45] Date of Patent: Oct. 3, 1995

[54] ACTIVITY TOY

[75] Inventor: Lee Spielberger, Warwick, R.I.

[73] Assignee: Hasbro, Inc., Pawtucket, R.I.

[21] Appl. No.: 297,207

[22] Filed: Aug. 29, 1994

[51] Int. Cl.[6] ..... A61H 33/00

[52] U.S. Cl. ..... 446/71; 446/227

[58] Field of Search ..... 446/71, 227, 378; 248/130, 124, 201, 675; 403/94, 93, 92, 3; 273/309, 280, 284, 887; 108/110, 107, 62, 6

[56] References Cited

U.S. PATENT DOCUMENTS

| | | | |
|---|---|---|---|
| D. 339,173 | 9/1993 | Marschak . | |
| 2,563,671 | 8/1951 | Basinger . | |
| 2,690,912 | 10/1954 | Noble . | |
| 2,941,774 | 6/1960 | McTear . | |
| 3,330,524 | 7/1967 | Foley . | |
| 3,577,675 | 5/1971 | Kohner | 446/227 |
| 3,641,946 | 2/1972 | Charnay | 108/6 |
| 3,836,144 | 9/1974 | Mahoney | 248/130 |
| 3,907,303 | 9/1975 | Locker . | |
| 4,188,745 | 2/1980 | Harvey et al. | 446/227 |
| 4,508,307 | 4/1985 | Morales . | |
| 4,552,362 | 11/1985 | Oake | 273/309 |
| 4,627,588 | 12/1986 | Block | 446/227 |
| 4,746,296 | 5/1988 | Tulgan | 446/227 |
| 4,986,501 | 1/1991 | Simon | 248/130 |
| 5,250,002 | 10/1993 | Kinberg | 446/227 |
| 5,265,969 | 11/1993 | Chuang | 403/94 |

*Primary Examiner*—Robert A. Hafer
*Assistant Examiner*—Michael O'Neill
*Attorney, Agent, or Firm*—Kurt R. Benson

[57] ABSTRACT

An activity toy for a child includes an activity board member having opposite first and second side faces, a pair of keyed mounting shafts which extend outwardly from opposite side edges of the activity board member and a pair of support frame members for supporting the activity board member on a supporting surface. The mounting shafts are alternatively receivable in several different predetermined dispositions on the support frame members for alternatively supporting the activity board member in a variety of different angular dispositions.

7 Claims, 8 Drawing Sheets

ACTIVITY TOY

BACKGROUND AND SUMMARY OF THE INVENTION

The instant invention relates to activity toys for young children and more particularly to an activity toy comprising an activity board member and a pair of support members which are operative for supporting the activity board member in a variety of different angular dispositions on a supporting surface.

Activity boards and related apparatus have generally been found to be effective for capturing the attention of young children for extended periods of time. In this regard, activity boards generally comprise a basic board structure having a plurality of movable activity components mounted thereon which are adapted for operating with various interesting action movements. For example, activity components such as rotatable wheels, rollers, etc., depressible noisemaker elements, and movable ball elements have previously been incorporated in activity board structures. However, most of the heretofore known activity board assemblies have been permanently mounted on supporting structures, and hence, they have not been adapted to be positioned in various different angular orientations on supporting surfaces. As a result, in many cases they have not been convenient to operate or adapted for use by young children of different sizes and ages.

The instant invention provides a highly effective activity toy comprising an activity board member and a pair of support frame members which are operative for mounting the activity board member in a variety of different angular dispositions, including one in which the activity board member is inverted so that an easel surface thereof is located in an operative position for use by a young child. More specifically, the activity toy of the instant invention comprises an activity board member having spaced opposite first and second faces and spaced opposite first and second side edges, first and second substantially coaxial mounting shafts extending outwardly from the first and second side edges, respectively, and first and second support frame members for supporting the activity board member in upwardly spaced relation to a supporting surface. Each of the support frame members has spaced first and second mounting apertures therein which are adapted for removably receiving the mounting shafts therein, and the activity toy further comprises orienting means for orienting the activity board member in a first angular disposition when the mounting shafts are received in the first apertures in the support frame members and for orienting the activity board member in a different second angular disposition when the mounting shafts are received in the second apertures in the support frame members. The orienting means is preferably also operative for orienting the activity board member in an inverted disposition in which the activity board member is inverted relative to the second disposition when the mounting shafts are received in the second apertures. The first and second support frame members preferably also each have a third aperture therein, and the orienting means is preferably operative for orienting the activity board member in a different third angular disposition when the mounting shafts are received in the third apertures. Still further, the orienting means is preferably constructed so that it is alternatively operative for supporting the activity board member in different fourth and fifth angular dispositions which are different from the first, second and third dispositions when the mounting shafts are received in the first apertures. The orienting means preferably comprises a key member on each of the mounting shafts and at least one key slot extending from each of the mounting apertures, and the key members are dimensioned to be received in the different key slots for orienting the board member in different angular dispositions on the support frame members. The activity board member preferably has a plurality of activity elements on the first face thereof, and it preferably has a drawing table surface on the second face thereof, and the activity board member preferably includes an easel clip adjacent to the drawing table surface on the second face thereof for securing a sheet of paper on the drawing table surface. The mounting shafts preferably comprise threaded terminal end portions, and the activity toy preferably further comprises first and second threaded nuts which are receivable in threaded engagement on the threaded terminal end portions. The activity toy preferably still further comprises detent means which are operative between the threaded nuts and the support members for releasably locking the positions of the nuts on the shafts.

It has been found that the activity toy of the instant invention has a relatively high level of appeal as a result of its adjustability to accommodate the needs and desires of various young children. Specifically, it has been found that because the activity toy of the instant invention is adapted for positioning the activity board member so that the first face thereof, which has the activity elements thereon, is in one of several different upwardly facing angular dispositions or so that the second face thereof, which has the drawing table surface thereon, is in one of several different upwardly facing dispositions, the activity toy of the instant invention is highly versatile and readily adapted to meet the needs of various children. Hence, the activity toy of the instant invention has significant advantages over the less versatile heretofore available activity products.

Accordingly, it a primary object of the instant invention to provide an activity toy comprising an activity board member which is adapted to be positioned in a variety of different angular dispositions.

Another object of the instant invention is to provide an activity toy comprising an activity board member having a pair of outwardly extending mounting shafts thereon and a pair of mounting frames having mounting apertures therein which are adapted for receiving the mounting shafts in order to position the activity board member in a variety of different predetermined angular positions.

Another object of the instant invention is to provide an activity toy comprising an activity board member having a plurality of activity elements on one surface thereof, and having a drawing table surface on an opposite second surface thereof wherein the activity board member is alternatively positionable in a variety of predetermined angular dispositions.

An even still further object of the instant invention is to provide an activity toy comprising an activity board member having keyed mounting shafts thereon which are receivable in apertures in support frame members for positioning the activity board member in a variety of different predetermined angular dispositions.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
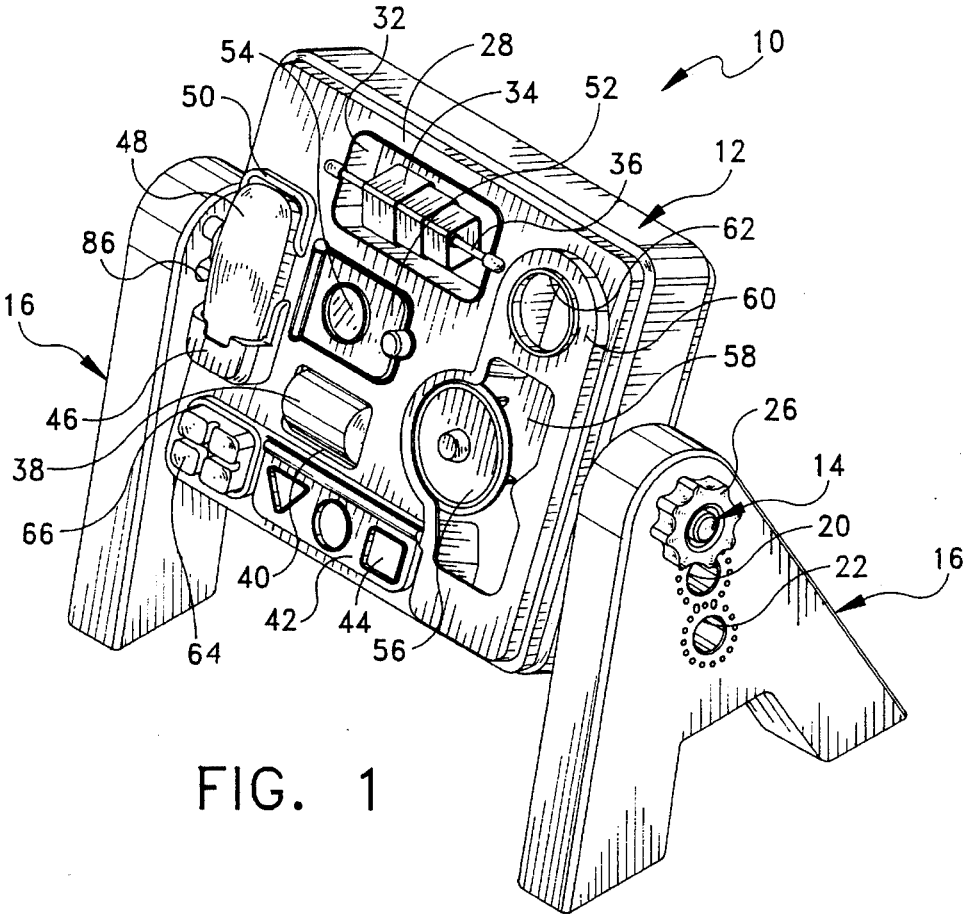
FIG. 1 is a perspective view of the activity toy of the instant invention in a first position.
Figure 2:
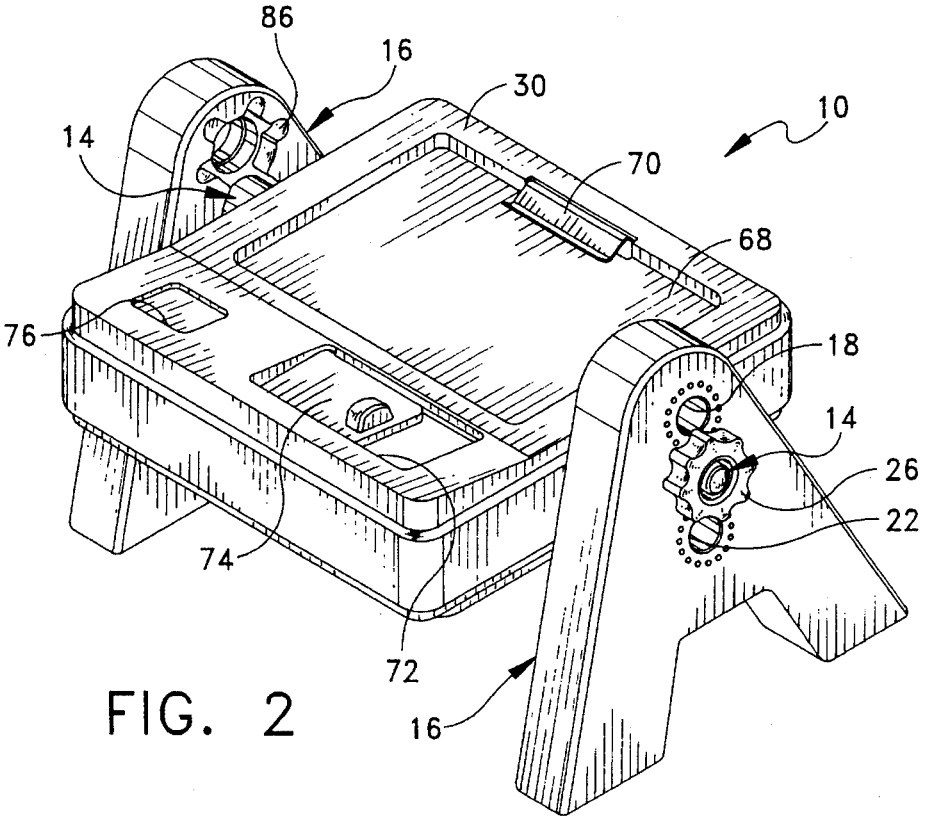
FIG. 2 is a perspective view thereof in a second position.
Figure 3:
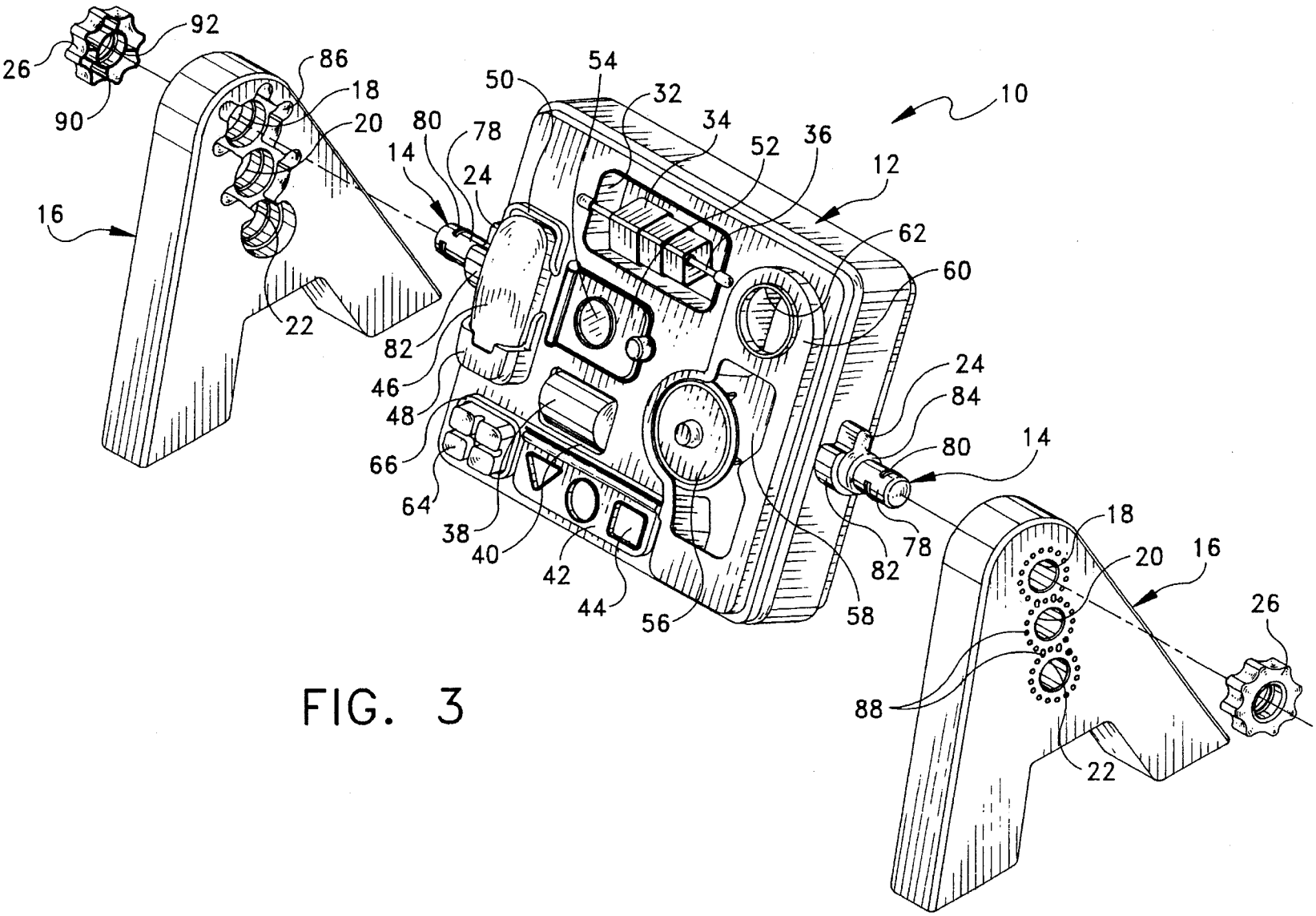
FIG. 3 is an exploded perspective view of the activity toy in the first position.

Referring now to the drawings, the activity toy of the instant invention is illustrated in FIGS. 1 through 13 and generally indicated at 10 in FIGS. 1 through 3. The activity toy 10 comprises an activity board member generally indicated at 12, a pair of mounting shafts generally indicated at 14 which extend outwardly from the activity board member 12, and a pair of mounting frame members generally indicated at 16. The mounting frame members 16 have first, second and third mounting apertures 18, 20, and 22, respectively, therein for receiving the mounting shafts 14, and the activity toy 10 further comprises key elements 24 which are operative for orienting the shafts 14 in the apertures 18, 20 and 22 in order to position the board member 12 in a variety of predetermined angular dispositions relative to the frame members 16. The activity toy 10 further comprises a pair of threaded nuts 26 which are receivable on the shafts 14 for retaining them in assembled relation with the frame members 16.

The board member 12 is illustrated in FIGS. 1 through 3, and it comprises a generally rectangular element having opposite first and second sides or faces 28 and 30, respectively. The board member 12 is preferable molded from a suitable plastic material, and the first side 28 thereof has a plurality of activity elements of various configurations mounted thereon. In this regard, as herein embodied the activity board member 12 includes a recess 32 having a plurality of interfitting blocks 34 mounted on a rod 36 therein. The activity board member 12 further includes a roller 38 which is mounted in a recess 40, a shape sorter 42 which is pivotally mounted in front of a recess 44, and an imitation telephone element 48 which is received in brackets 46 and 50. The board member 12 still further comprises a door 52 which is hingeably mounted in front of a mirror 54 and a rotatable paddle member 56 which is mounted in a recess 58. The board member 12 still further comprises a recess cover member 60 which extends around the paddle member 56 and defines an aperture 62 for receiving ball elements and the like in the recess 58. In addition, the board member 12 as herein embodied comprises a depressible noisemaker element 64 which is mounted in a recess 66.

The second side 30 of the board member 12 has a substantially flat drawing surface 68 formed thereon and an easel clip 70 is provided adjacent the drawing surface 68 for retaining a sheet of paper or the like thereon. The second side 30 further includes a recessed storage compartment 72 having a slidable door 74 and a label area 76. Accordingly, when the second surface 30 is in an at least partially upwardly facing disposition, the activity toy 10 can be utilized as an easel or drawing board, and drawing instruments or the like can be effectively stored in the recess 72 so that they are readily available.

The mounting shafts 14 extend outwardly from opposite side edges of the board member 12 in substantially coaxial relation so that they can be effectively utilized for mounting the activity board member 12 on the mounting frame members 16 in the manner illustrated in FIGS. 1 and 2. Each of the shafts 14 includes a terminal end portion 78 having a thread element 80 thereon, and each of the shafts 14 is integrally formed with one of the key elements 24 as illustrated. Further, each of the assemblies comprising a shaft 14 and the associated key element 24 includes a base portion 82 which extends slightly more than halfway around the shaft 14 thereof and extends outwardly with the respective key element 24 thereof. Each of the assemblies comprising a shaft 14 and a key element 24 further includes a circular boss 84 which extends outwardly from the base portion 82 thereof and the key element 24 thereof to the terminal end portion 78 thereof.

Each of the support frame members 16 is formed in a generally upwardly tapering A-frame like configuration and each has three vertically spaced apertures 18, 20 and 22 formed therein which are dimensioned for receiving the shaft 14, including the boss 84 thereof, the base portion 82 thereof, and the key element 24 thereof. In this regard, however, as illustrated in FIGS. 3, 5 and 8 through 13, each of the apertures 18, 20 and 22 is formed so that it includes at least one outwardly extending positioning lobe 86 for receiving a key element 24 therein in order to orient the board member 12 in a predetermined orientation relative to the support frame members 16. In this regard, as illustrated in FIGS. 3, 5 and 8 through 13, the uppermost apertures 18 each have four different lobes 86 (the area where the recesses surrounding the apertures 18 and 20 merge is not intended to be used as a positioning lobe) in order to provide four predetermined positions for the key members 24 so that the board member 12 can be mounted in four different predetermined angular dispositions. Further, as also illustrated, the aperture 20 has two outwardly extending lobe areas 86 therearound, and the aperture 22 has a single upwardly extending lobe area 86 which merges with the recess surrounding the aperture 20 to provide an additional mounting position for the board member 12.

Figure 4:
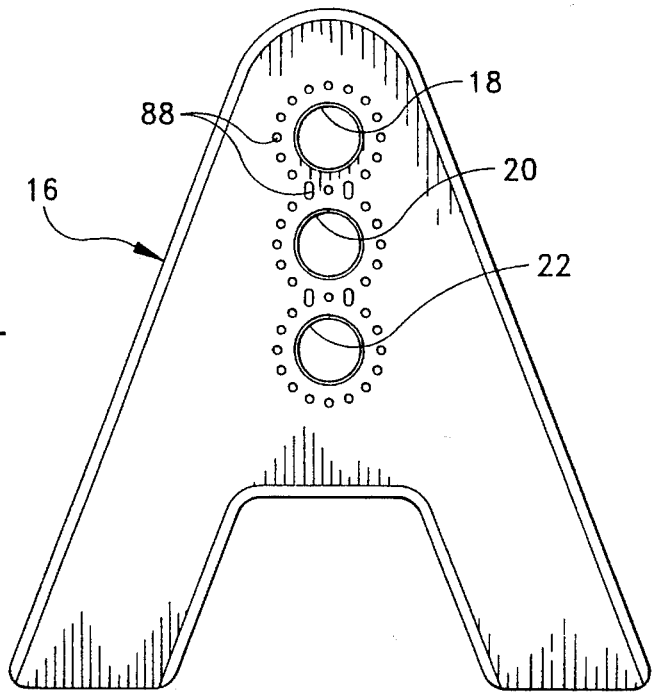
FIG. 4 is a side elevational view of the outer side of one of the support frame members.
Figure 5:
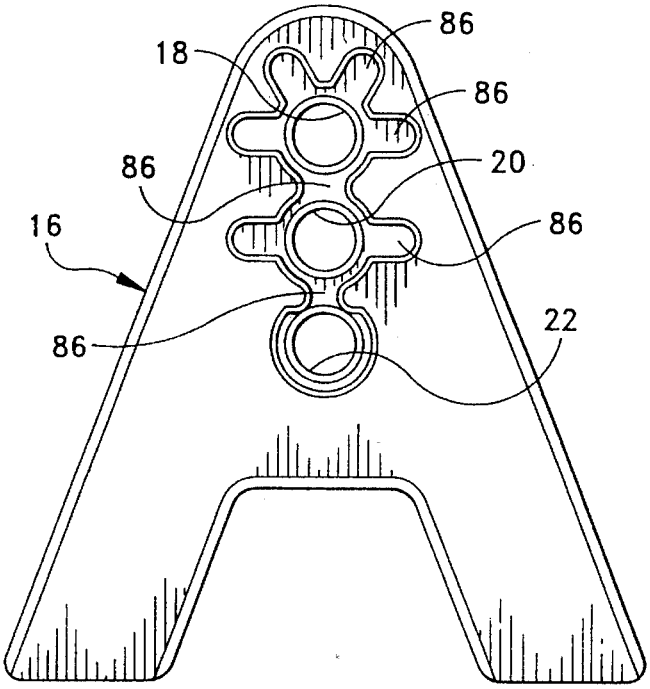
FIG. 5 is a side elevational view of the inner side thereof.
Figure 6:
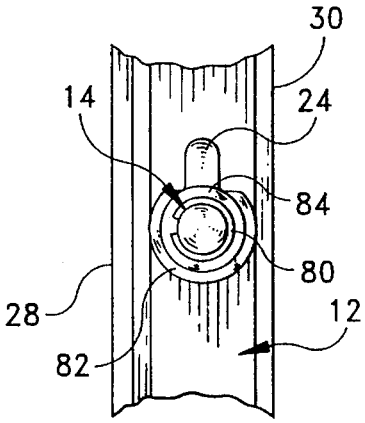
FIG. 6 is a fragmentary side sectional view of the activity board member illustrating one of the keyed mounting shafts thereon.
Figure 7:
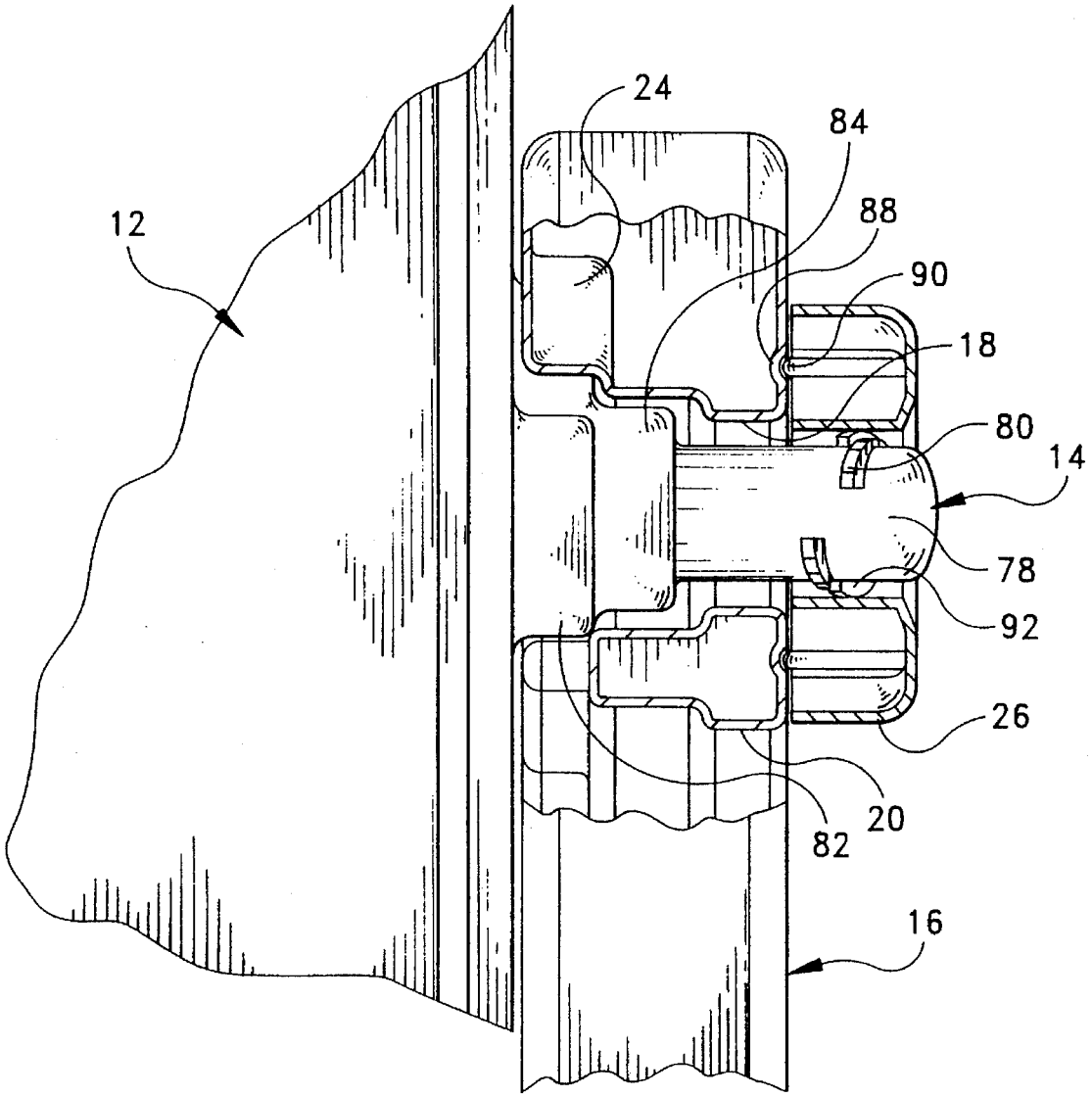
FIG. 7 is a fragmentary sectional view illustrating the assembly of one of the support shafts with a support frame member.
Figure 8:
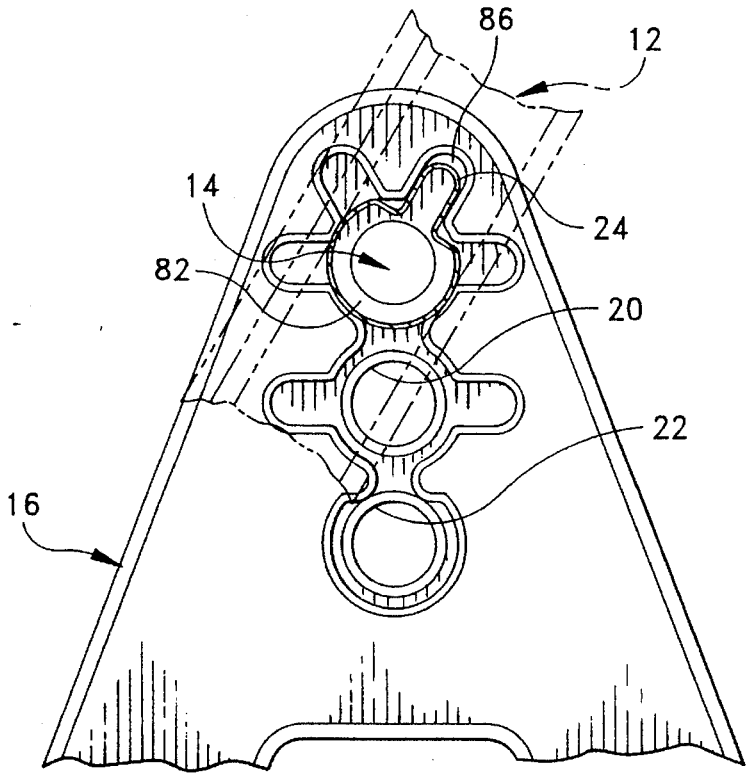
FIGS. 8 through 15 illustrate the assembly of the activity board member with one of the support frame members in a variety of different predetermined angular dispositions.
Figure 9:
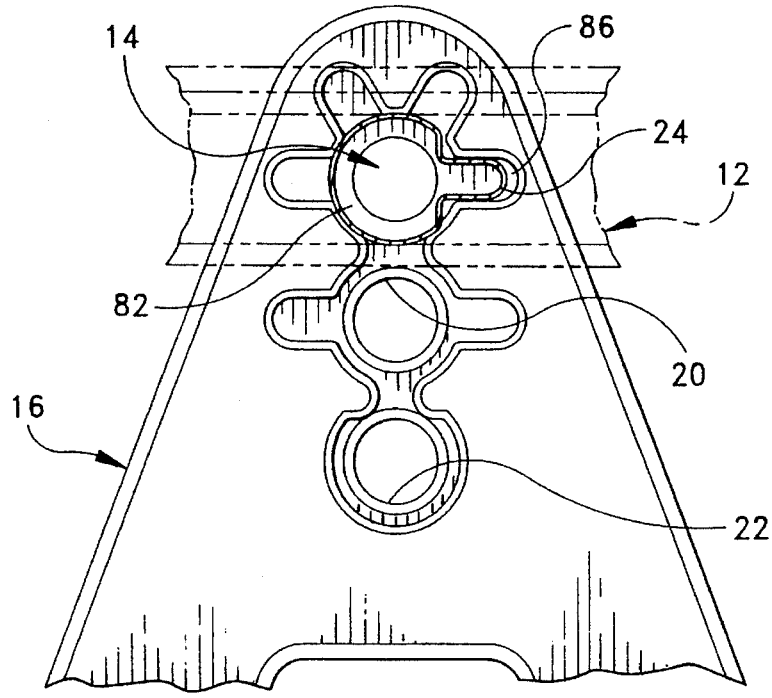
Figure 10:
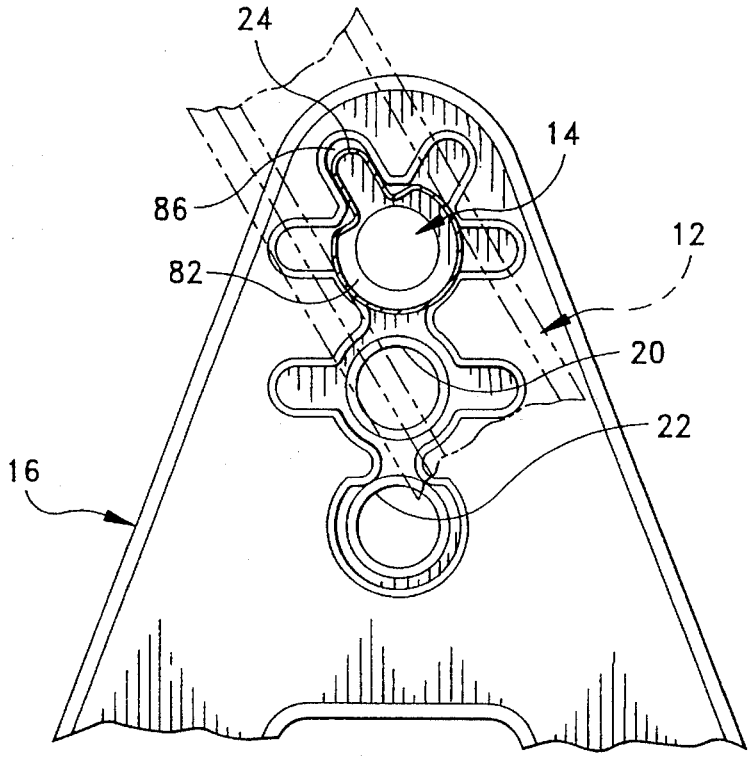
Figure 11:
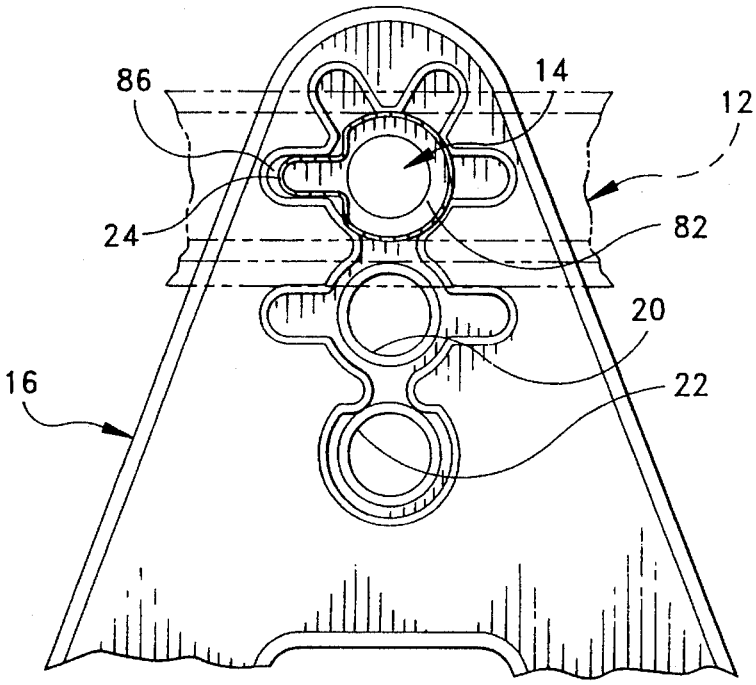
Figure 12:
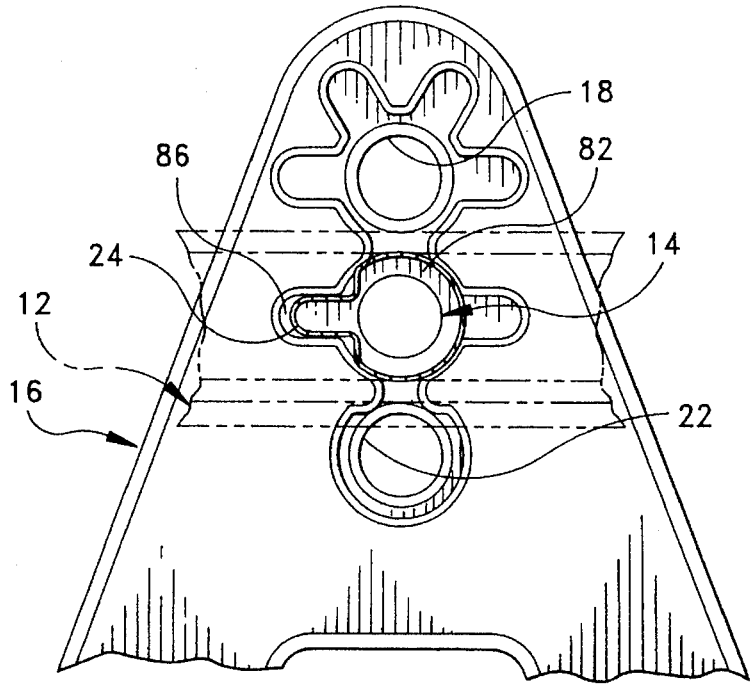
Figure 13:
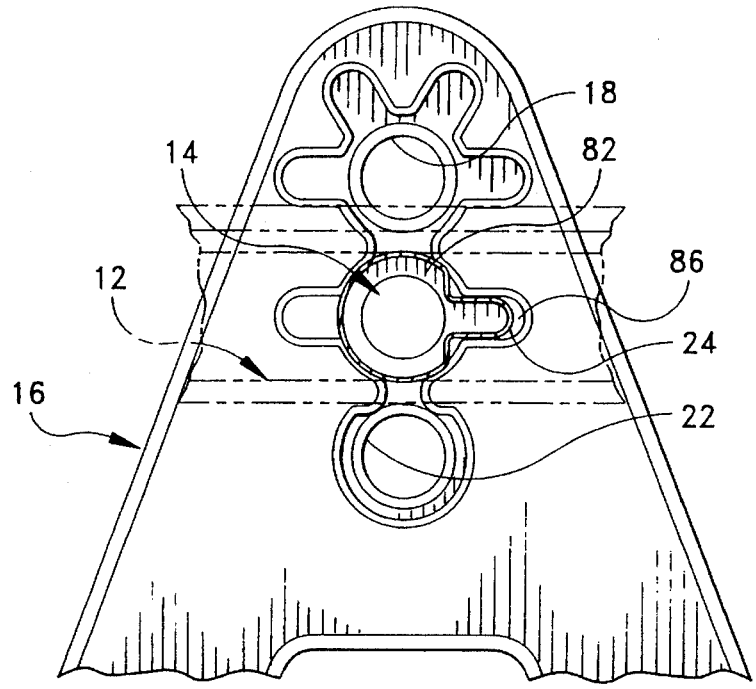
Figure 14:
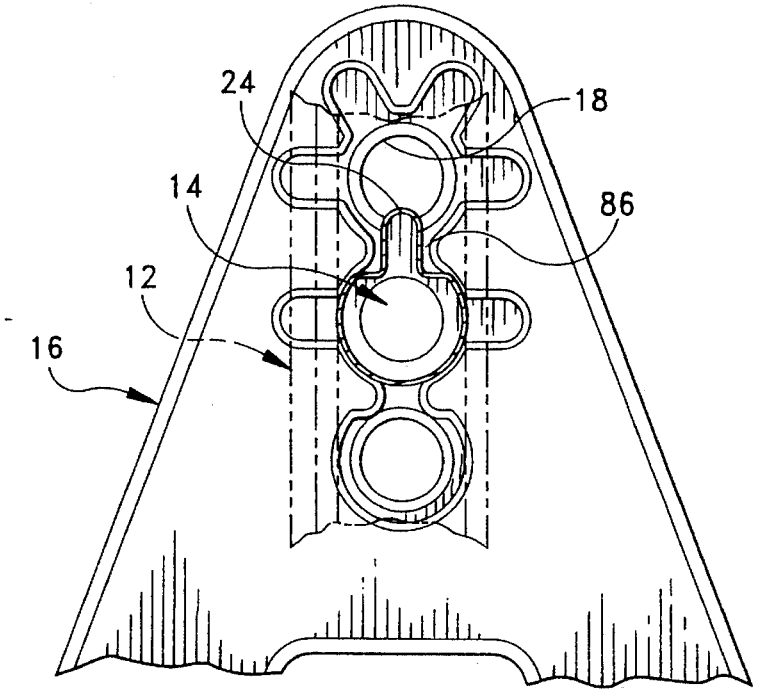
Figure 15:
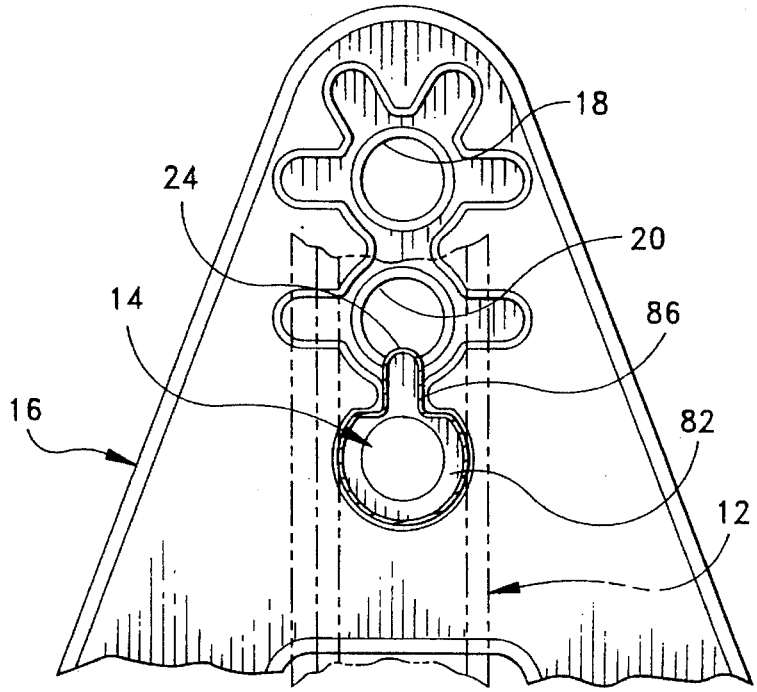

As illustrated most clearly in FIGS. 3 and 4, each of the support frame members 16 also has a plurality of detent recesses 88 formed in the outwardly facing side thereof. The detent recesses 88 are positioned in circular concentric arrays around the apertures 18, 20 and 22 for receiving cooperating detent elements 90 on the threaded nuts 26 as will hereinafter be more fully set forth.

The nut elements 26 are preferably also molded from a suitable plastic material, and the detent elements 90 are formed on the inwardly facing sides thereof so that they are receivable in the recesses 88 as the nut elements 26 are tightened onto the shafts 14. The nut elements 26 have threads 92 formed therein which are receivable in engagement with the threads 80 to tighten the nut elements 26 on the shafts 14. In this regard, as the nut elements 26 are tightened on the shafts 14, the nut elements 26 are gradually drawn toward their adjacent support frame members 16 until the detents 90 are received in the corresponding detent recesses 88, and the detent elements 90 pass into sequential recesses 88 until the nut elements 26 are fully tightened at which point the detents 90 and the recesses 88 cooperate to releasably lock the nut elements 26 in position on their respective shafts 14.

Referring now to FIGS. 8 through 13, the cooperative relationship between the key elements 24 and the lobes 86 when the shafts 14 are received in the apertures 18, 20 or 22 is illustrated. As will be seen, the key elements 24 are readily receivable in different lobes 86 to orient the board member 12 in a variety of different positions so that the activity toy 10 can be more conveniently used by young children of different ages. Specifically, the key elements 24 and the lobes 26 make it possible to position the activity board member 12 in various different vertical, horizontal, or inclined dispositions in which either the first side 28 or the second side 30 of the board member is maintained in a convenient operative position. Further, the key elements 24 prevent the board member 12 from rotating in the apertures 18, 20 or 22, and the detent elements 90 effectively lock the nut elements 26 in position on the shafts 14 so that the nut elements 26 are not readily removable by a young child. When the board member 12 is in a vertical disposition, both the first side 28 and the second side 30 are readily accessible to a young child, and when the first side 28 is in an upwardly facing inclined or horizontal disposition, the various activity elements on the first side 28 are readily accessible to a child. On the other hand, when the second side 30 is in an upwardly facing horizontal or inclined disposition, the drawing surface 68 can be conveniently used by a child during a drawing exercise.

It is seen, therefore, that the instant invention provides an effective activity toy for a child. The activity board member 12 is positionable in a variety of different predetermined dispositions on the support frame members 16. Further, the key elements 24 and the lobes 86 provide a convenient mechanism for adjustably securing the activity table member 12 to the support frame members 16, and the recesses 88 and the detent members 90 provide a convenient mechanism for releasably locking the nut elements 26 on the shafts 14. Hence, the various features of the activity toy 10 make it both highly desirable and convenient to operate for a young child. Accordingly, the activity toy 10 is felt to represent a significant advancement in the related art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. An activity toy for a child comprising:

an activity board member having spaced opposite first and second faces and spaced opposite first and second side edges;

first and second substantially coaxial mounting shafts extending outwardly from said first and second side edges, respectively;

first and second support frame members for supporting said activity board member in upwardly spaced relation to a supporting surface, said first and second support frame members each having spaced first and second mounting apertures therein, said mounting apertures being adapted for alternatively removably receiving said mounting shafts therein; and orienting means for orienting said activity board member in a first angular disposition when said mounting shafts are received in said first apertures and for orienting said activity board member in a different second angular disposition when said mounting shafts are received in said second apertures, said orienting means comprising a key member on each of said mounting shafts and at least one key slot extending from each of said mounting apertures, said key member being alternatively receivable in different key slots for orienting said board member different angular dispositions on said support frame members.

2. An activity toy for a child comprising:

an activity board member having spaced opposite first and second faces and spaced opposite first and second side edges, said activity board member having a plurality of activity elements on the first face thereof and having a drawing table surface on the second face thereof;

first and second substantially coaxial mounting shafts extending outwardly from said first and second side edges, respectively;

first and second support frame members for supporting said activity board member in upwardly spaced relation to a supporting surface, said first and second support frame members each having spaced first and second mounting apertures therein, said mounting apertures being adapted for alternatively removably receiving said mounting shafts therein; and orienting means for orienting said activity board member in a first angular disposition when said mounting shafts are received in said first apertures and for orienting said activity board member in a different second angular disposition when said mounting shafts are received in said second apertures.

3. An activity toy for a child comprising:

an activity board member having spaced opposite first and second faces and spaced opposite first and second side edges;

first and second substantially coaxial mounting shafts extending outwardly from said first and second side edges, respectively, said mounting shafts comprising threaded terminal end portions;

first and second threaded nuts receivable in threaded engagement on said threaded terminal end portions;

first and second support frame members for supporting said activity board member in upwardly spaced relation to a supporting surface, said first and second support frame members each having spaced first and second mounting apertures therein, said mounting apertures being adapted for alternatively removably receiving said mounting shafts therein;

detent means operative between said nuts and said support members for releasably locking the positions of said threaded nuts on said shafts; and orienting means for orienting said activity board member in a first angular disposition when said mounting shafts are received in said first apertures and for orienting said activity board member in a different second angular disposition when said mounting shafts are received in said second apertures.

4. An activity toy for a child comprising:

an activity board member having spaced opposite first and second faces and spaced opposite first and second side edges;

first and second substantially coaxial mounting shafts extending outwardly from said first and second side edges, respectively;

first and second support frame members for supporting said activity board member in upwardly spaced relation to a supporting surface, said first and second support frame members each having spaced first and second mounting apertures therein, said mounting apertures being adapted for alternatively removably receiving said mounting shafts therein; and orienting means for orienting said activity board member in a first angular disposition when said mounting shafts are received in said first apertures and for orienting said activity board member in a different second angular disposition when said mounting shafts are received in said second apertures, said orienting means also being operative for orienting said activity board member in an inverted disposition in which said activity board member is inverted relative to said second angular disposition when said mounting shafts are received in said second apertures.

5. In the activity toy of claim 1, said first and second support frame members each also having a third aperture therein which is spaced from the first and second apertures therein, said orienting means being operative for orienting said board member in a third angular disposition which is different from said first and second angular dispositions when said mounting shafts are received in said third apertures.

6. In the activity toy of claim 5, said orienting means being alternatively operative for supporting said board member in different fourth and fifth angular dispositions which are different from said first, second and third dispositions when said mounting shafts are received in said first apertures.

7. In the activity toy of claim 6, said board member further comprising an easel clip adjacent said drawing table surface on the second face theroef.

* * * * *